US006151908A

United States Patent [19]

Graaff

[11] Patent Number: 6,151,908

[45] Date of Patent: Nov. 28, 2000

[54] LARGE-VOLUME REFRIGERATED SHIPPING CONTAINER

[75] Inventor: Wolfgang Graaff, Chicago, Ill.

[73] Assignee: Contrail GmbH, Stade, Germany

[21] Appl. No.: 09/193,708

[22] Filed: Nov. 17, 1998

[30] Foreign Application Priority Data

Nov. 17, 1997 [DE] Germany ..... 297 20 349 U

[51] Int. Cl.[7] ..... F25D 3/08

[52] U.S. Cl. ..... 62/371; 62/407; 62/416; 62/417

[58] Field of Search ..... 62/371, 407, 416, 62/417

[56] References Cited

U.S. PATENT DOCUMENTS

| | | | |
|---|---|---|---|
| 2,305,075 | 12/1942 | Gilpin | 62/416 |
| 2,305,141 | 12/1942 | Crede | 62/416 |
| 3,362,179 | 1/1968 | Krikpatrick | 62/416 |
| 3,386,260 | 6/1968 | Kirkpatrick | 62/416 |
| 3,702,544 | 11/1972 | Grinups | 62/416 |
| 4,553,584 | 11/1985 | Bloomquist | 62/417 |
| 5,946,933 | 9/1999 | Clarke et al. | 62/417 |

*Primary Examiner*—William Doerrler
*Assistant Examiner*—Mark Shulman
*Attorney, Agent, or Firm*—Herbert Dubno; Andrew Wilford

[57] ABSTRACT

A large-volume shipping container has a pair of upright and spaced side walls and a floor extending between lower edges of the side walls and formed with at least two groups of full-length passages upwardly open at respective full-length slots. In accordance with the invention the passages of one of the groups has a flow cross section different from the passages of the other group. A roof extends between upper edges of the side walls, a rear end door wall extends between rear edges of the roof, floor, and side walls, and a front end wall extends between front edges of the roof, floor, and side walls and defines with the roof, floor, and other walls a closed cargo-containing space. A refrigerating apparatus in the front end wall forces cool air into front ends of the passages to distribute the cool air through the space differentially according to the flow cross sections of the passages. Normally there are two side groups of the passages flanking a center group of the passage and the flow cross sections of the passages of the center group are smaller than the flow cross sections of the passages of the side groups.

15 Claims, 8 Drawing Sheets

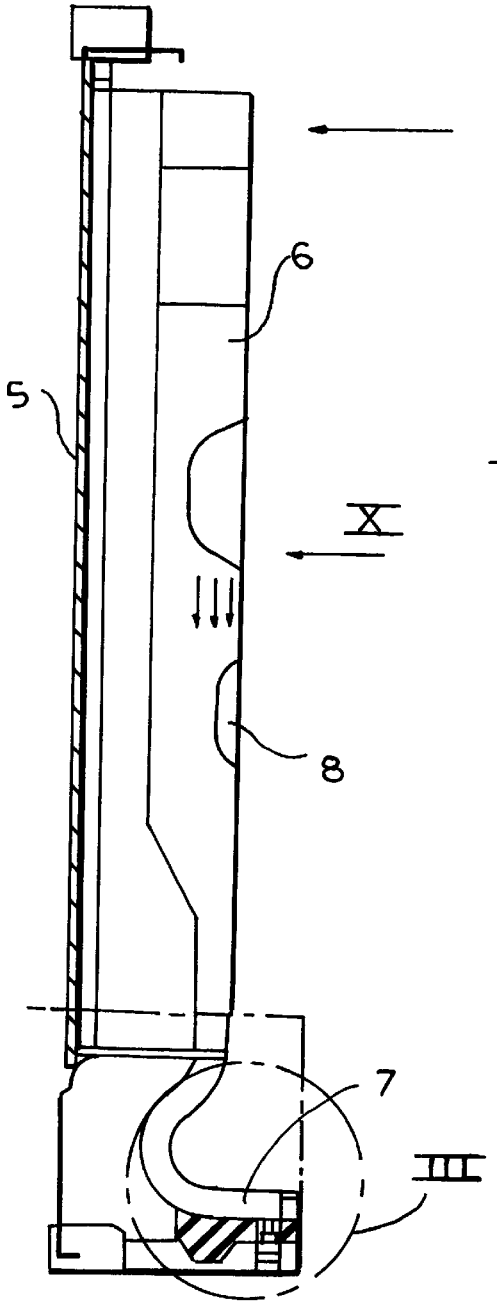
FIG. 2
FIG. 3
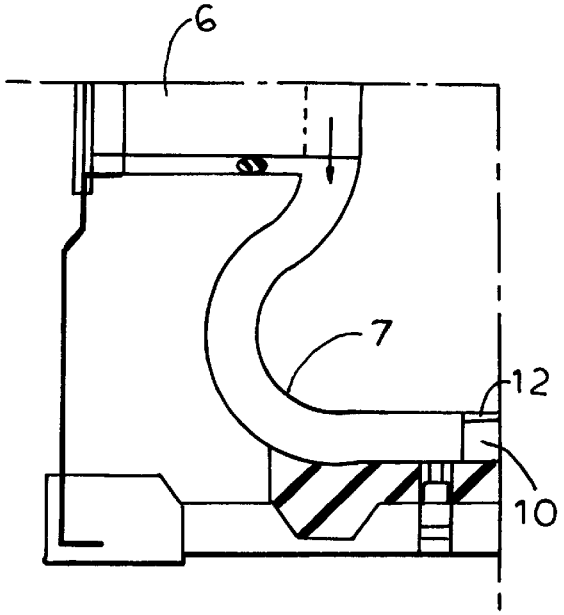

LARGE-VOLUME REFRIGERATED SHIPPING CONTAINER

FIELD OF THE INVENTION

The present invention relates to a shipping container. More particularly this invention concerns a large-volume refrigerated and insulated shipping container.

BACKGROUND OF THE INVENTION

A standard transcontainer for shipping produce, frozen food, or the like is basically an elongated parallepipedal box having a closed front end wall, a rear wall formed by a pair of doors, side walls, a roof or top wall, and a floor. Most of the walls are formed as two metal sheets or skins sandwiching a mass of closed-cell insulation. The top skin of the floor is provided with a plurality of longitudinally extending T-section rails that define longitudinal passages or slots and the side walls have vertical grooves. The front wall is provided with a refrigerating apparatus that draws air in from upper regions of the container, chills it, and expels it to front ends of the floor passages so that it is distributed through the container to cool all the freight inside the container.

Such a transcontainer meeting the international ISO standards has an electrically driven refrigerating apparatus that is set right into the front end wall. Air is sucked in adjacent the roof, chilled, and then fed back under the load. In the taller 9 ft 6 in so-called high-cube containers the cool air is also fed in along the side walls. Getting such a container, which can be 40 ft to 45 ft long, fully cooled is very difficult and the cargo in the rear door area frequently is insufficiently chilled. Since the load temperature is normally determined by a sensor located at the chiller's intake, such a system often is running with the rearmost parts of the load some 5° to 10° warmer than desired but, due to inefficient air circulation, is seemingly running correctly. The result is insufficiently frozen goods, often rising to +2° C. to +12° C.

The main problem with the known containers is that they are made as large as possible. The refrigerating plants are appropriately dimensioned, but once the containers are fully loaded, air circulation is so poor that some of the cargo is insufficiently cooled. The rear door region is particularly problematic because it is so far from the cooling plant. This plant itself must be dimensioned small enough to fit in the front wall with 300 mm to 400 mm wide passages on each side for air movement. The air distribution is ultimately quite uneven, with the core of the load being adequately cooled and rear and side parts of the load thawing.

OBJECTS OF THE INVENTION

It is therefore an object of the present invention to provide an improved large-volume refrigerated cargo container.

Another object is the provision of such an improved large-volume refrigerated cargo container which overcomes the above-given disadvantages, that is which ensures that all of the contained load will be adequately chilled.

SUMMARY OF THE INVENTION

A large-volume shipping container has according to the invention a pair of upright and spaced side walls and a floor extending between lower edges of the side walls and formed with at least two groups of full-length passages upwardly open at respective full-length slots. In accordance with the invention the passages of one of the groups has a flow cross section different from the passages of the other group. A roof extends between upper edges of the side walls, a rear end door wall extends between rear edges of the roof, floor, and side walls, and a front end wall extends between front edges of the roof, floor, and side walls and defines with the roof, floor, and other walls a closed cargo-containing space. A refrigerating apparatus in the front end wall forces cool air into front ends of the passages to distribute the cool air through the space differentially according to the flow cross sections of the passages. Normally according to the invention there are two side groups of the passages flanking a center group of the passage and the flow cross sections of the passages of the center group are smaller than the flow cross sections of the passages of the side groups.

With this system, therefore, the dimensions of the various cool-air flow passages ensure that the cool air is distributed evenly throughout the cargo space.

In accordance with the invention the floor has an array of parallel T-section rails which have heads defining a common support plane, which define the passages and slots, and of which the rails in the center group are shorter than the rails in the side groups. The cooler includes a conduit for directing between 40% and 60% of the cool air to the center group and between 60% and 40% to the side groups. In addition each side wall is formed with a side-wall passage having a front end connected to the refrigerating apparatus and a rear end at the rear end door wall. In fact each side wall is formed with a plurality of such side-wall passages spaced vertically from one another. Conduits connect the side-wall passages to the refrigerating apparatus. Each such conduit can be provided with a spring-loaded closure flap that opens away from the cooler. Thus when back pressure in the floor passages is to great, for instance because a tightly packed load is blocking all the floor openings, these flaps will open to allow the cool air into the side passages to flow that way around the load. The system is thus auto adjusting.

Each side wall further has according to the invention a substantially planar inner face and the grooves are each provided with a cover plate generally flush with the respective face. Each such cover plate is formed generally only over a rear portion of its length with throughgoing apertures so that the cool air in the respective groove is generally only released to a rear region of the space. This rear portion is equal to about a third of an overall length of the side wall. Furthermore each wall has a side-wall groove running along a corner between an outer edge of the floor and a lower edge of the respective side wall.

The refrigerating apparatus in accordance with the invention is provided with a controller for distributing the cool air between the side-wall grooves and the floor passages. This controller includes at least one temperature sensor adjacent an upper edge of the rear end door wall. The door wall itself is provided with at least one openable door formed with at least one vertically extending air-conducting groove connected to the refrigerating apparatus. These vertical grooves open into rear ends of respective floor passages.

BRIEF DESCRIPTION OF THE DRAWING

The above and other objects, features, and advantages will become more readily apparent from the following description, reference being made to the accompanying drawing in which:

FIG. 2 is a larger-scale side sectional view through the front wall of the container;

FIG. 3 is a large-scale view of the detail indicated at III in FIG. 2;

SPECIFIC DESCRIPTION

Figure 1:
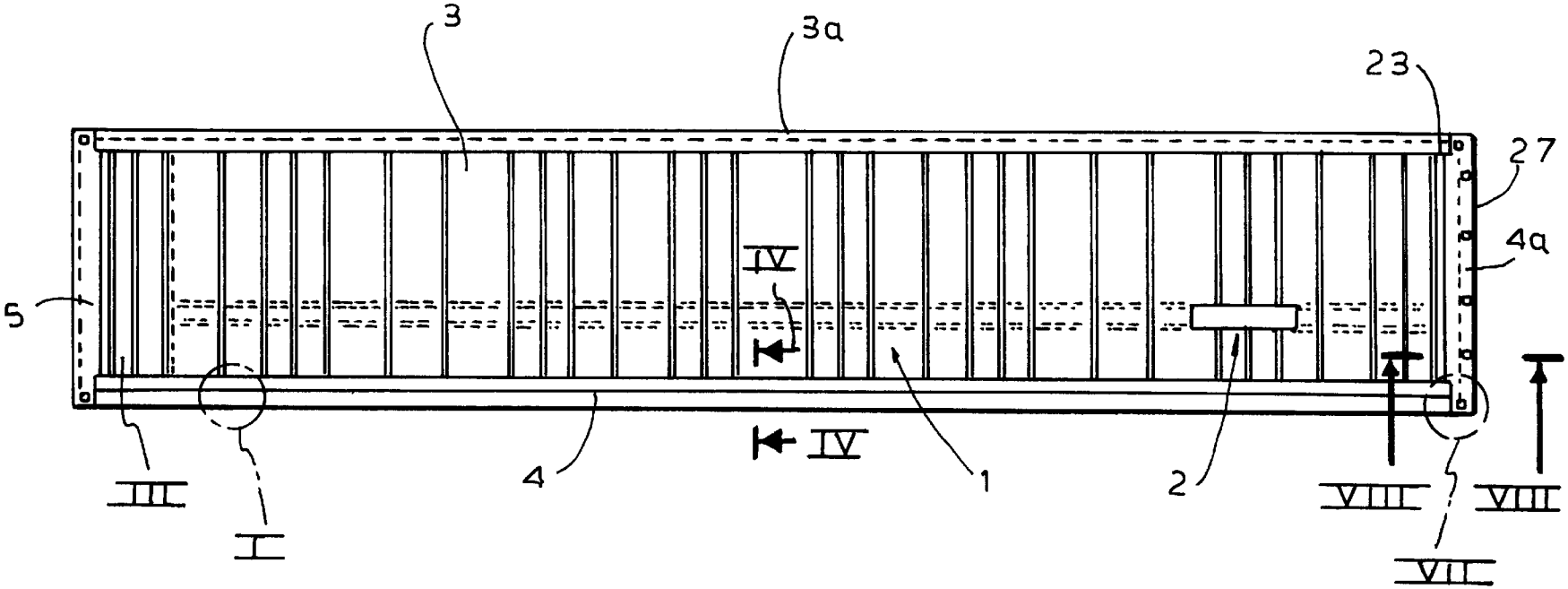
FIG. 1 is a small-scale side view of the container according to the invention.
Figure 4:
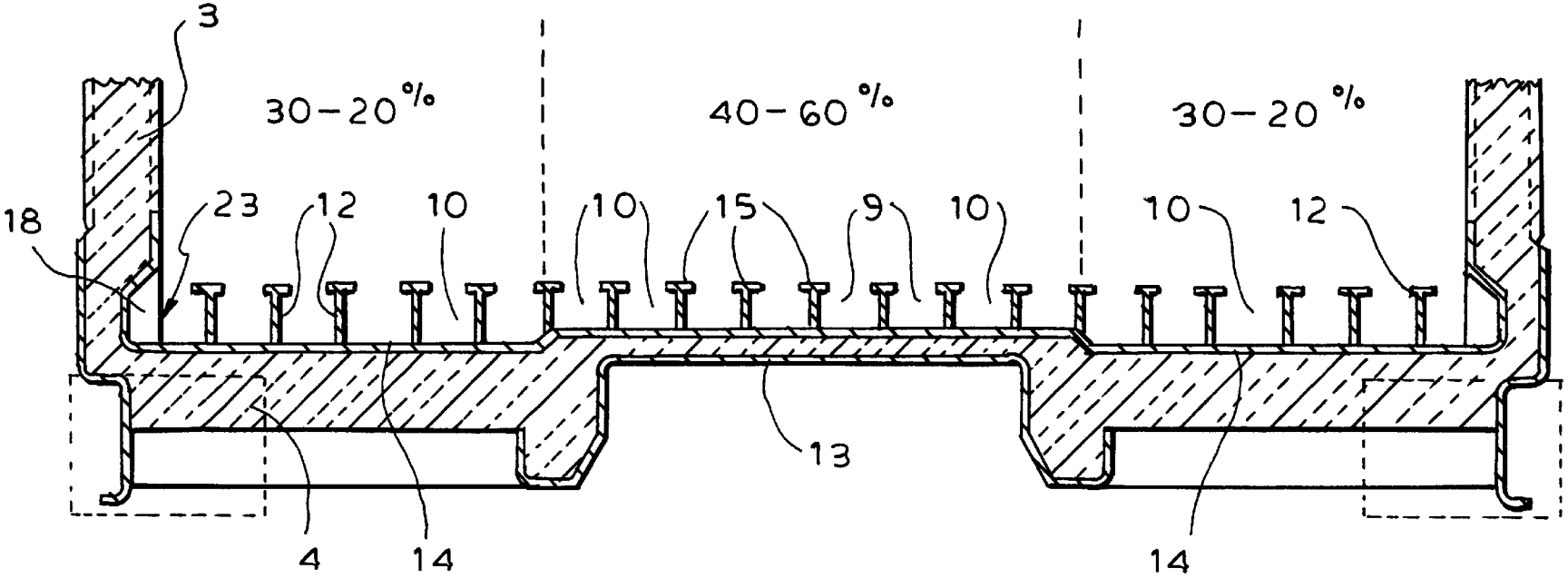
FIG. 4 is a cross section taken along line IV—IV of FIG. 1.
Figure 5:
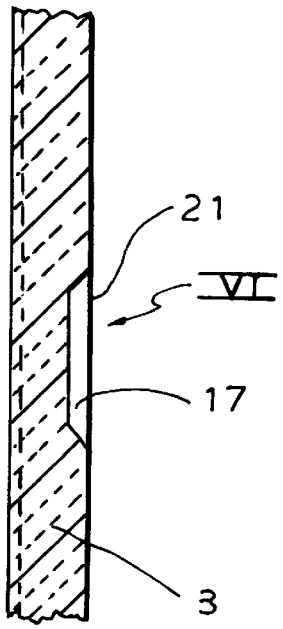
FIG. 5 is a cross section through a portion of a side wall of the container.

As seen in FIG. 1 a refrigerated transcontainer 1 has a pair of insulated and upright side walls 3, a rear door wall 4*a*, a front wall 5, a floor 4, and a roof 3*a* defining a parallepipedal cargo space 2. The front wall 5 as shown in FIG. 2 holds a refrigerating apparatus or cooler 6 having outlet conduits 7 also shown in FIGS. 2 and 3. The floor 4 as shown in FIG. 4 is formed by an array of T-section rails 12 having coplanar heads 15 and defining longitudinally extending passages 10 opening upward at longitudinally extending full-length slots 9. The heads 15 form a solid planar surface onto which cargo can be loaded, and the gaps or slots 9 ensure that cold air fed by the conduits 7 to the ends of the passages 10 can exit along the full length of the container 1.

Figure 10:
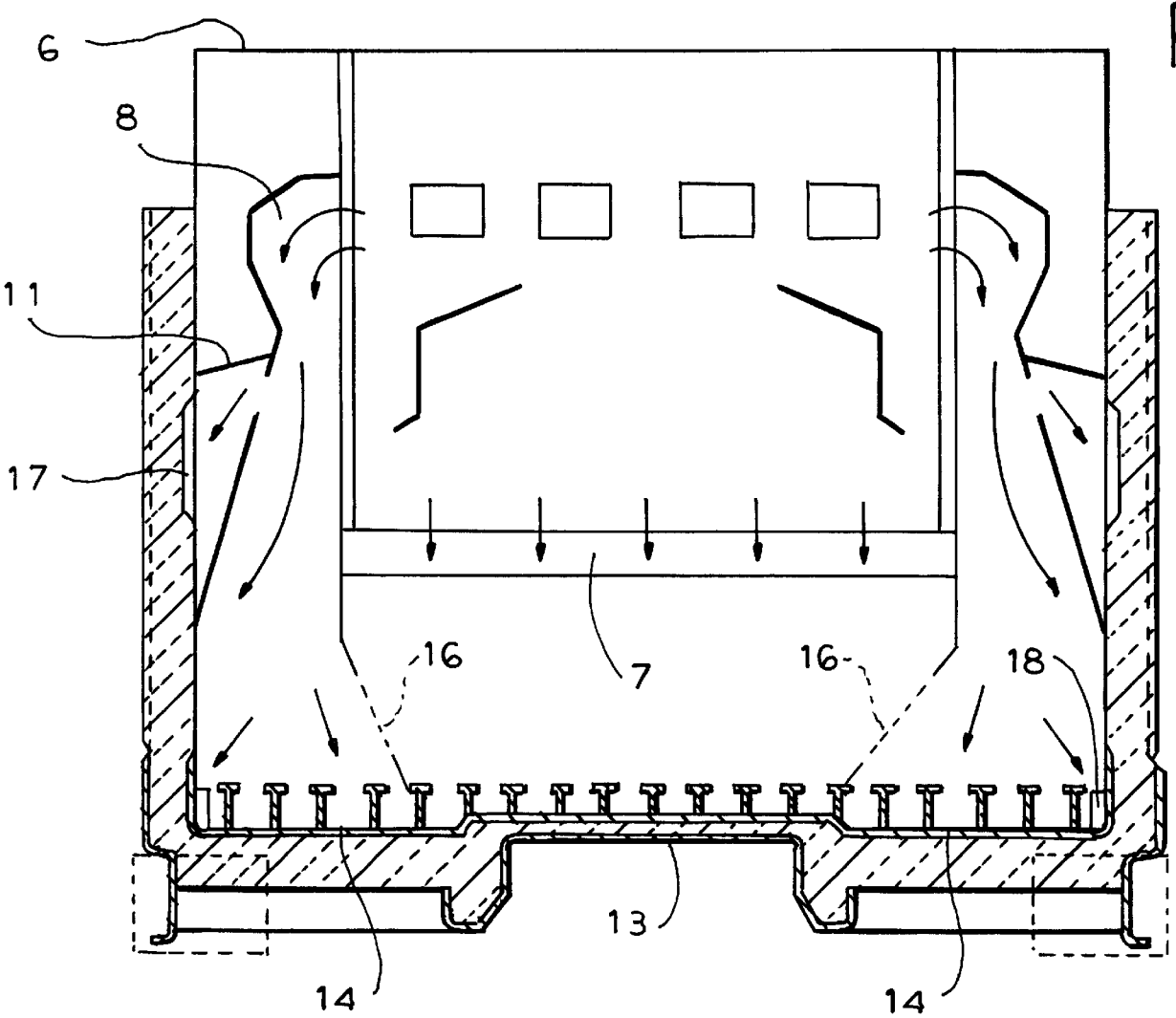
FIG. 10 is a rear view taken in the direction of arrow X of FIG. 2.

The rails 12 are shorter in a central region 13 than in flanking side regions 14 so that each side region 14 gets between 20% and 30% of the total air flow while the central region only gets between 40% an 60% of this flow, ensuring that the bulk of the cold air goes to the critical side regions of the cargo space 2. Separate outlet passages 16 (FIG. 10) can be provided for this split distribution.

Figure 6:
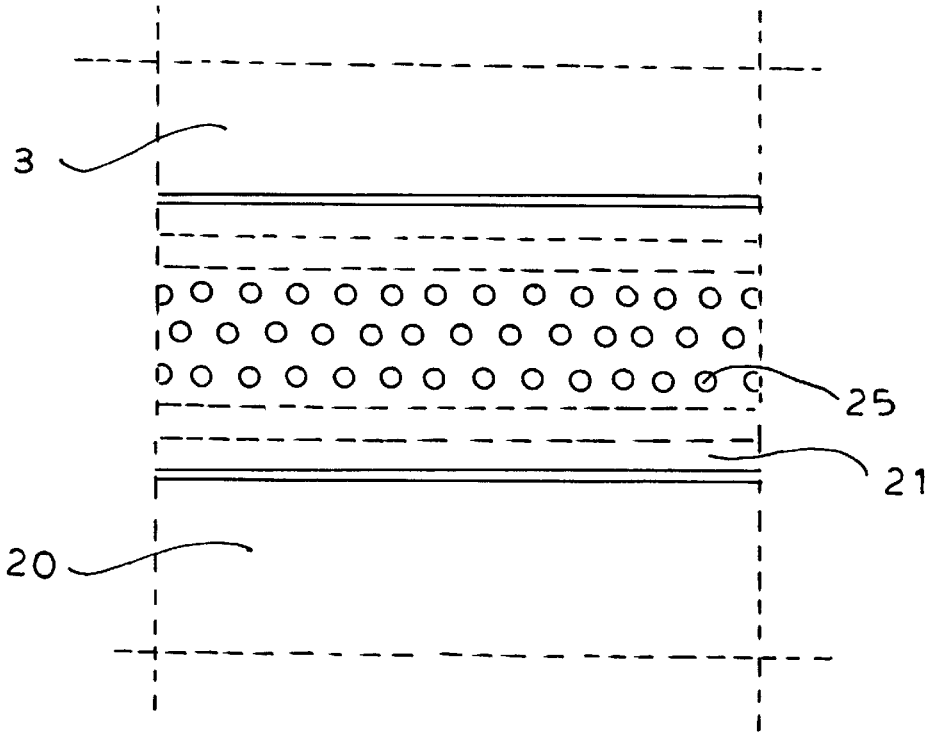
FIG. 6 is a view taken in the direction of arrow VI of FIG. 5.

In addition the cooler 6 has outlets 8 (FIGS. 2 and 10) that open into side-wall passages 17 and 18, the former spaced vertically and extending along the side walls 3 and the latter at a corner 23 between the side wall 3 and the floor 4. These passages 17 and 18 are formed as grooves in the insulating material of the walls 3 and are covered by plates 21 formed at least in the rear third of the container 1 with throughgoing apertures or holes 25 (FIG. 6) that allow the cool air to flow into the space 2. The covers 21 are flush and coplanar with inner metal faces 22 of the walls 3. Spring-loaded flaps indicated schematically at 11 in FIG. 10 can be provided blocking flow into the side passages 17 so that only when there is considerable back pressure in the passages 10, resulting from tight loading of the space 2, are these flaps 11 pushed back for flow into the passages 17.

Figure 7:
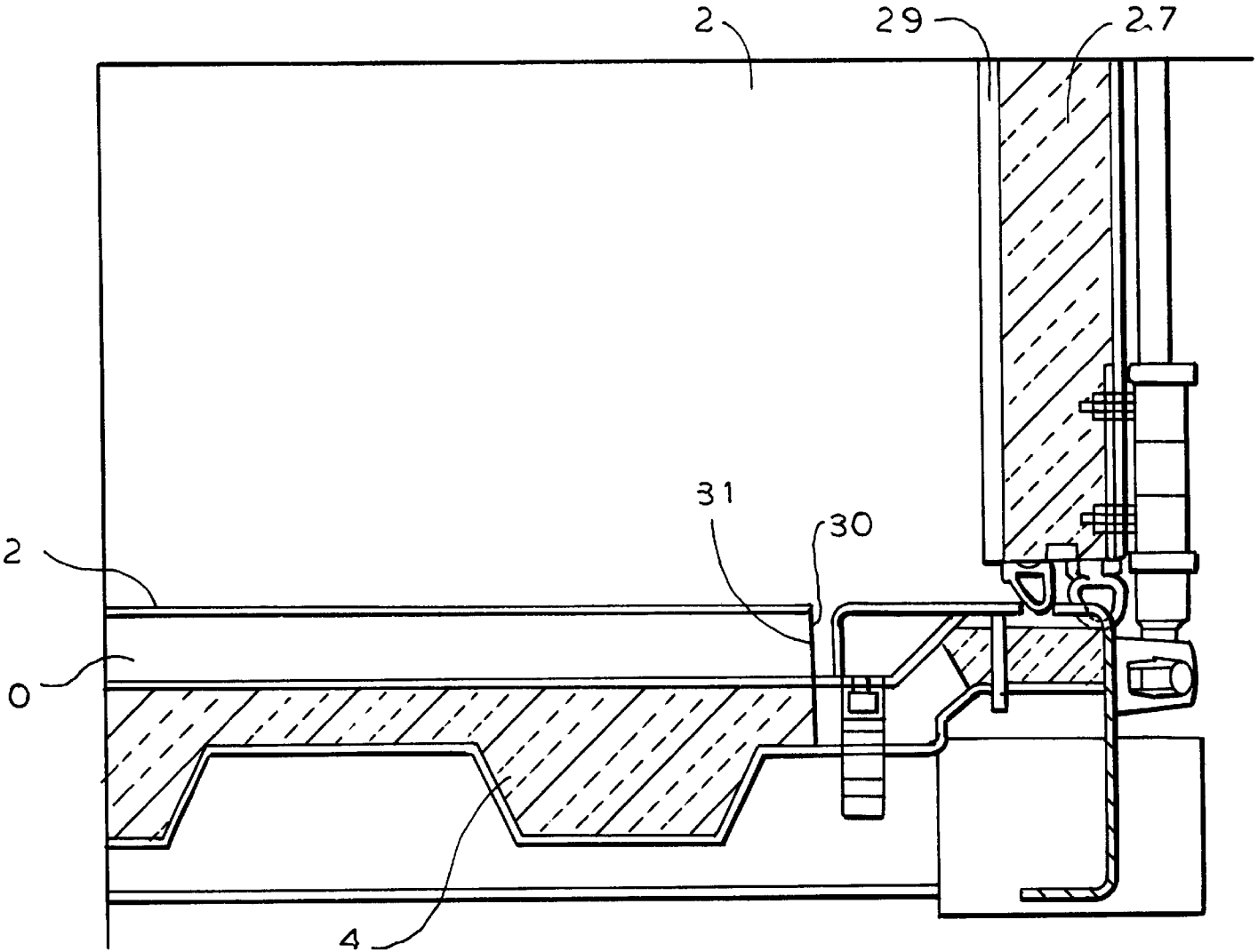
FIG. 7 is a large-scale section through the detail indicated at VII in FIG. 1.
Figure 8:
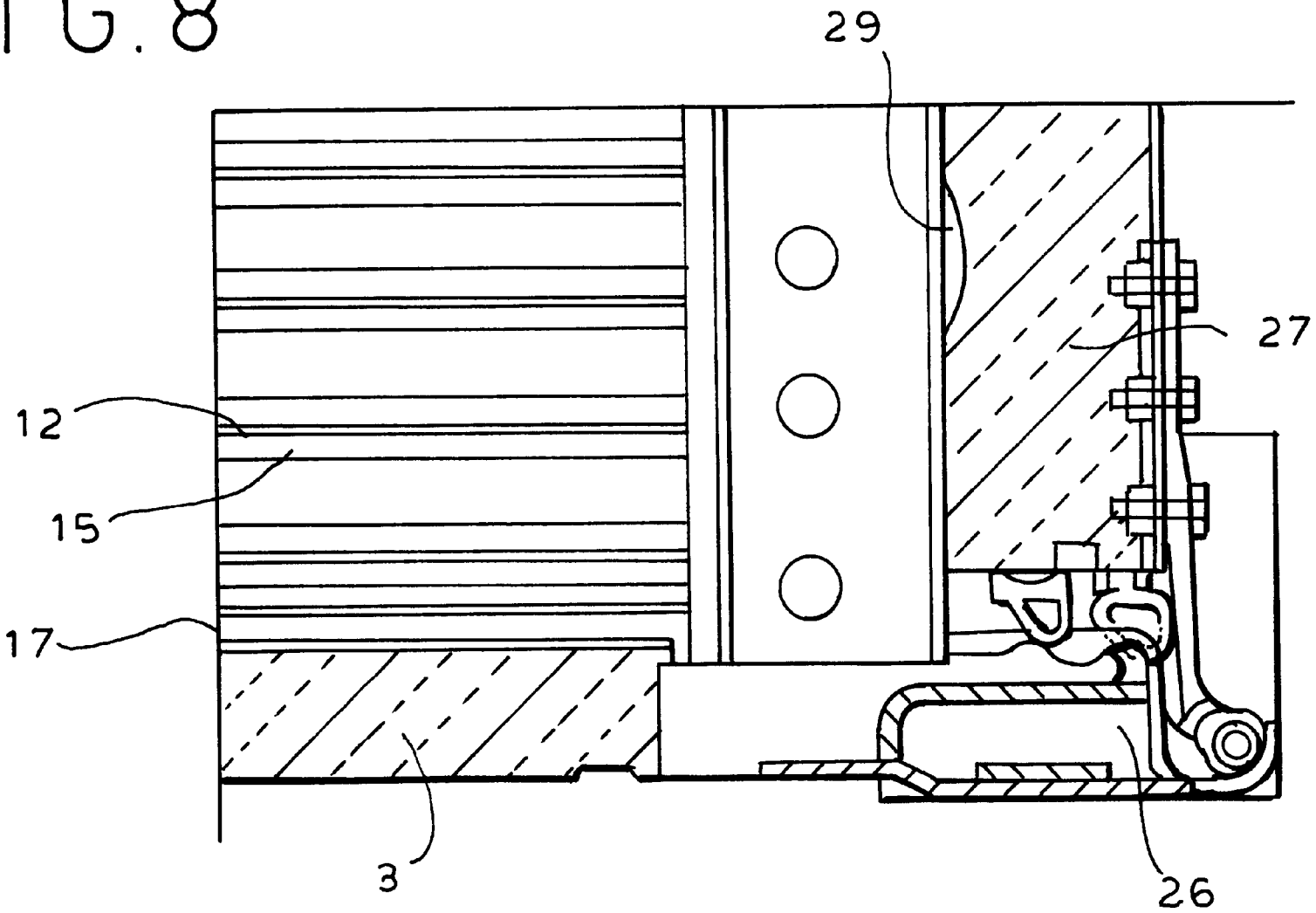
FIG. 8 is a large-scale section taken along line VIII—VIII of FIG. 1.
Figure 9:
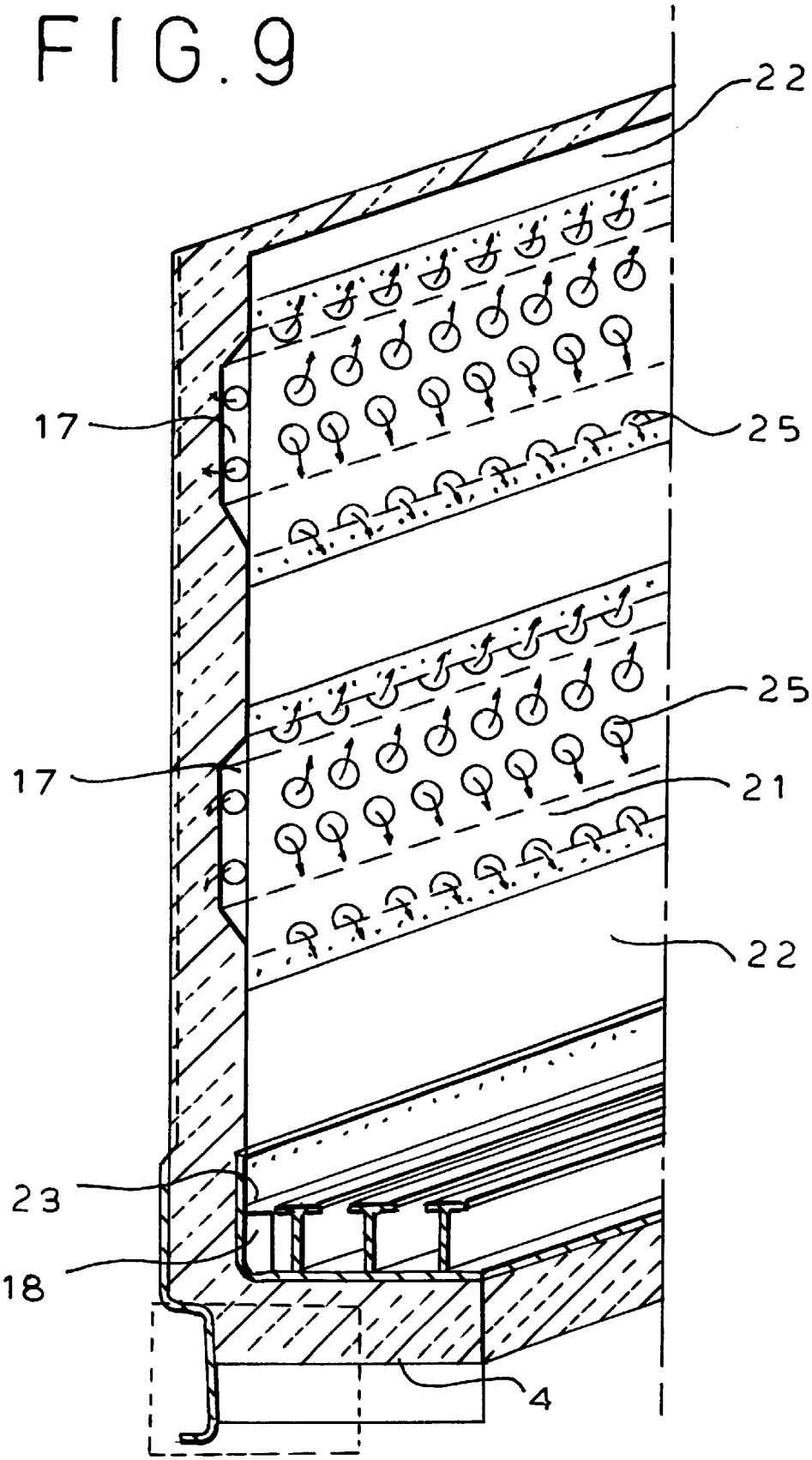
FIG. 9 is a perspective and partly sectional view of a corner between the floor and side wall of the container.

At the rear end 4*a* of the container 1 as shown in FIGS. 7 and 8 are door posts 26 to which are hinged insulated doors 27 formed with vertical grooves 29 connected at 30 to rear ends 31 of the passages 10 of the floor 4. Thus air flows out the rear ends 31 into the bottoms of the passages or grooves 29 to ensure full cooling of cargo even at the extreme rear end of the container 1.

I claim:

1. A large-volume shipping container comprising:

a pair of upright and spaced side walls;

a floor extending between lower edges of the side walls and formed with at least two side groups and one center group of full-length passages upwardly open at respective full-length slots, the side groups flanking the center group, the passages of the center group having a flow cross section different from the passages of the side groups;

a roof extending between upper edges of the side walls;

a rear end door wall extending between rear edges of the roof, floor, and side walls;

a front end wall extending between front edges of the roof, floor, and side walls and defining with the roof, floor, and other walls a closed cargo-containing space; and means including a refrigerating apparatus in the front end wall for forcing cool air into front ends of the passages and for distributing the cool air through the space differentially according to the flow cross sections of the passages.

2. The shipping container defined in claim 1 wherein the floor has an array of parallel T-section rails which have heads defining a common support plane, which define the passages and slots, and of which the rails in the center group are shorter than the rails in the side groups.

3. The shipping container defined in claim 1 wherein the means includes a conduit for directing between 40% and 60% of the cool air to the center group and between 60% and 40% to the side groups.

4. The shipping container defined in claim 1 wherein each side wall is formed with a side-wall passage having a front end connected to the refrigerating apparatus and a rear end at the rear end door wall.

5. The shipping container defined in claim 4 wherein each side wall is formed with a plurality of such side-wall passages spaced vertically from one another.

6. The shipping container defined in claim 4, further comprising conduits connecting the side-wall passages to the refrigerating apparatus.

7. The shipping container defined in claim 6 wherein each conduit is provided with a spring-loaded closure flap.

8. The shipping container defined in claim 4 wherein each side wall has a substantially planar inner face and the grooves are each provided with a cover plate generally flush with the respective face.

9. The shipping container defined in claim 8 wherein each cover plate is formed generally only over a rear portion of its length with throughgoing apertures, whereby the cool air in the respective groove is generally only released to a rear region of the space.

10. The shipping container defined in claim 9 wherein the rear portion is equal to about a third of an overall length of the side wall.

11. The shipping container defined in claim 4 wherein each wall has a side-wall groove running along a corner between an outer edge of the floor and a lower edge of the respective side wall.

12. The shipping container defined in claim 4 wherein the refrigerating apparatus is provided with control means for distributing the cool air between the side-wall grooves and the floor passages.

13. The shipping container defined in claim 12 wherein the control means includes at least one temperature sensor adjacent an upper edge of the rear end door wall.

14. The shipping container defined in claim 1 wherein the rear end door wall is provided with at least one openable door formed with at least one vertically extending air-conducting groove connected to the refrigerating apparatus.

15. The shipping container defined in claim 14 wherein the vertical grooves open into rear ends of respective floor passages.

* * * * *